United States Patent [19]

Dosaka

[11] Patent Number: 4,571,890

[45] Date of Patent: Feb. 25, 1986

[54] TRACK SLIDER GRINDER

[75] Inventor: Akira Dosaka, Koganei, Japan

[73] Assignee: Ikari Machine Tools Co., Ltd., Tokyo, Japan

[21] Appl. No.: 692,438

[22] Filed: Jan. 17, 1985

[30] Foreign Application Priority Data

Oct. 2, 1984 [JP] Japan ..... 59-207640

[51] Int. Cl.[4] ..... B24B 9/00

[52] U.S. Cl. ..... 51/92 ND; 51/419; 51/165.71; 51/217 R

[58] Field of Search ..... 51/92, 92 ND, 84 R, 51/85 R, 417, 419, 165.71, 217 R, 216 ND

[56] References Cited

U.S. PATENT DOCUMENTS

| | | | |
|---|---|---|---|
| 1,616,727 | 2/1927 | Williams | 51/92 ND |
| 3,651,602 | 3/1972 | Hillier | 51/96 |
| 4,115,956 | 9/1978 | Huffman | 51/96 |

*Primary Examiner*—Harold D. Whitehead

*Attorney, Agent, or Firm*—Flynn, Thiel, Boutell & Tanis

[57] ABSTRACT

A track slider grinder grinds a track slider of ferrite having a tracing surface and an integral C-shaped core positioned on one side of the tracing surface and including a coil support portion in the form of a quadrangular prism having a central axis. The track slider grinder includes a holder for supporting the track slider for rotation about the central axis of the coil support portion, a rotational drive source for angularly displacing said holder through a prescribed angle, a grinding tool for grinding an edge of the coil support portion of the core into a duller surface, a three-dimensional guide drive mechanism for relatively moving said grinding tool and said holder in X-, Y-, and Z-axis directions, and a numerical control unit for controlling said three-dimensional guide drive mechanism to position the track slider and said grinding tool relatively to each other and for enabling said grinding tool to grind the edge of the coil support portion of the core while relatively moving said grinding tool and the core in the direction of the central axis of the core. The grinding tool may comprise a rod-shaped rotatable sander or a sand blasting nozzle.

3 Claims, 10 Drawing Figures

7

TRACK SLIDER GRINDER

BACKGROUND OF THE INVENTION

1. Field of the Invention

The present invention relates to a device for grinding the edges of the core of a track slider.

2. Description of the Prior Art

Track sliders are incorporated in magnetic heads for use with magnetic discs for computers or video tapes, and serve as a transducer for converting an electric signal into a magnetic signal or vice versa. As illustrated in FIGS. 1 and 2 of the accompanying drawings, such a magnetic head has a track slider 1 as a major component. The track slider 1 is small in size and made of ferrite. The track slider 1 has a smooth tracing surface 2 and a positioning groove 3 defined in a surface remote from the tracing surface 2. A core 4 is integrally formed with one side of the tracing surface 2. The core 4 has a C shape as seen in side elevation and has a tip end defining a gap 5 and fixed by a body of melted glass 6 near the tracing surface 2. The core 4 has dimensions as indicated in FIGS. 1 and 2.

The core 4 includes a portion 7 in the form of a quadrangular prism serving as a coil support portion for supporting a coil 8. The coil 8 is composed of an enameled wire having turns in the range of from 10 to 25 around the coil support portion 7 for converting an electric signal into a magnetic signal or vice versa.

The coil support portion 7 is integrally formed when the ferrite core is fired or sintered, and hence has sharp edges having an angle of 90°. If the coil 8 were directly wound around the coil support portion 7, the insulating enamel coating would be peeled off, resuling in an insulation failure and a short circuit. Therefore, suitable insulation would have to be incoporated.

To avoid the above shortcoming, it has been customary practice to grind off edges 7*a* with a strip of sanding paper to form a suitable round surface. However, since the sanding operation has been manually effected, the efficiency is low, sanded surfaces have not been even, and the core 4 has sometimes been broken in the grinding operation.

There have been practiced alternatives instead of the above grinding process. One effort has been to wind an insulating tape around the core 4. Another attempt has been to fit a C-shaped insulating ring over the core 4. If the insulation is attached to the coil support portion, then magnetic coupling between the core 4 and the coil 8 is lowered and weak signals cannot be well converted. Therefore, it has been found that the winding of the coil 8 directly around the core 4 is most effective.

SUMMARY OF THE INVENTION

It is an object of the present invention to provide a track slider grinder for mechanically grinding edges of the coil support portion of the core of a track slider with a high grinding efficiency to produce ground surfaces having reduced irregularities.

According to the present invention, numerical control technology is employed, and a grinding tool is positioned near an edge of a coil support portion of a track slider core. The edge is ground off into a blunt surface upon relative movement of the grinding tool and the core support portion. The grinding tool may comprise a rotatable rod-shaped grinder or a sand blasting nozzle. The edges of the coil support portion can be finished into uniform surfaces approximating curved surfaces within a short period of time, the ground surfaces being free of irregularities from product to product.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 3:
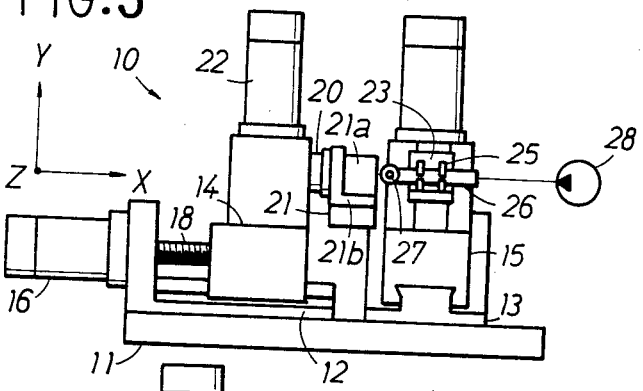
FIG. 3 is a front elevational view of a track slider grinder according to the present invention.
Figure 4:
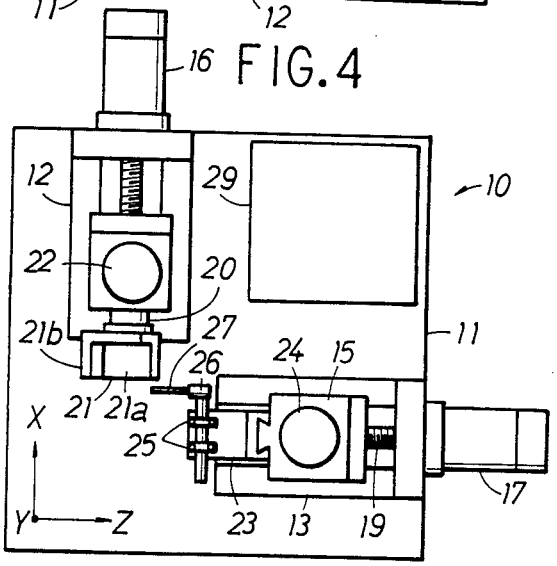
FIG. 4 is a plan view of the track slider grinder.

FIGS. 3 and 4 are illustrative of a track slider grinder 10 according to an embodiment of the present invention. The grinder 10 is mounted on a base 11 on which there are disposed an X-axis guide table 12 and a Y-axis guide table 13. Sliders 14, 15 are slidably supported on the guide tables 12, 13, respectively. The sliders 14, 15 are movable in their respective directions by means of feed motors 16, 17 mounted on rear ends of the guide tables 12, 13 and feed screws 18, 19 driven by the feed motors 16, 17, respectively.

The guide table 12 has on a front surface thereof a support shaft 20 extending in a Y-axis direction and supporting a holder 21 for angular movement. The support shaft 20 can be fixed in a suitable angular position by means of a rotational drive source 22 such as a motor or a rotary actuator mounted on an upper surface of the guide table 12. The holder 21 is made of a magnetic material and includes a four-sided support surface 21*a* having an integral L-shaped positioning stopper 21*b*.

The guide table 13 supports on a front guide surface a saddle 23 slidable in a Y-axis direction and drivable by a feed motor 24. The saddle 23 has attachments 25 by which a grinding tool 26 is fixed in the X-axis direction, the grinding tood 26 supporting a rod-shaped rotatable sander or grinding body 27 rotatable thereon and extending in a Z-axis normal to the X-axis direction. In response to introduction of a drive fluid from an external source, an air motor within the grinding tool 26 is rotated to rotate the grinding body 27 at a speed of about 400,000 to 300,000 RPM.

The guide tables 12, 13, the feed motors 16, 17, the feed screws 18, 19, the saddle 23, and the feed motor 24 jointly constitute a three-dimensional guide drive mechanism controlled by a numerical control unit 29 mounted on the upper surface of the base 11.

Figure 1:
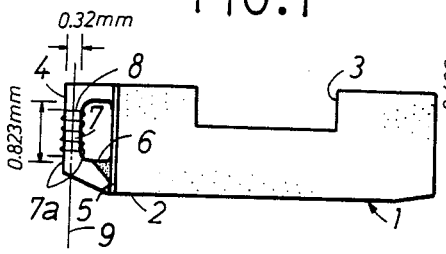
FIG. 1 is a side elevational view of a track slider to be ground.
Figure 2:
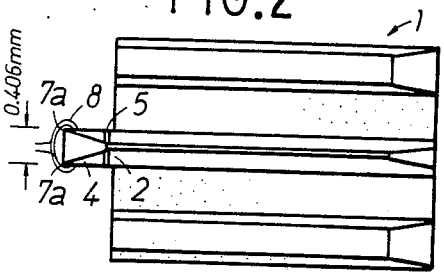
FIG. 2 is a front elevational view of the track slider.
Figure 5:
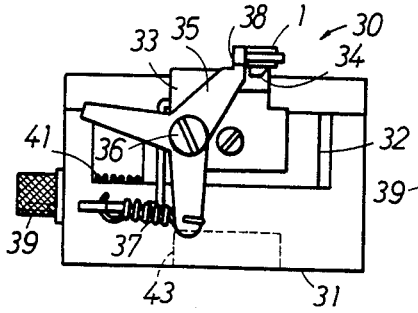
FIG. 5 is a front elevational view of a jig.
Figure 6:
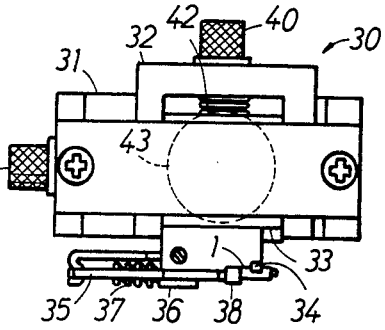
FIG. 6 is a plan view of the jig.

FIGS. 5 and 6 show a jig 30 for fixing the track slider 1 shown in FIGS. 1 and 2. The jig 30 comprises a block-shaped jig body 31 by which a channel-shaped slide frame 32 is slidably supported for sliding movement in the Z-axis direction. The slide frame 32 supports thereon a block-shaped slide frame 33 for sliding movement in the X-axis direction. The slide frame 33 has on a side surface thereof an integral support projection 34 for fitting engagement in the groove 3 in the track slider 1. A Y-shaped holder lever 35 is angularly movably mounted by a retaining shaft 36 on the slide frame 33. The holder lever 35 is normally urged by a tension spring 37 and has on a tip end a resilient holder piece 38 for contact with a rear end surfce of the track slider 1. The slide frames 32, 33 can positionally be adjusted in the X- and Z-axis directions by means of screws 39, 40, and holder springs 41, 42. A permanent magnet 43 for fixing the jig 30 in position is embedded in a bottom of the jig body 31.

Operation of the track slider grinder 10 will be described.

The track slider 1 is mounted on the jig 30 for efficiently effecting a series of grinding steps thereon. More specifically, the track slider 1 is fitted at its groove 3 over the projection 34, and held in place by the holder piece 38 of the holder lever 35. At this time, the holder piece 38 securely positions the track slider 1 between itself and the projection 34 under the resiliecy of the tension spring 37.

The jig 30 with the track slider 1 supported is then placed on the support surface 21*a* of the holder 21, and accurately positioned by the positioning stopper 21*b*. The coil support portion 7 of the track slider 1 has a central axis 9 which is now aligned with the axis of rotation of the support shaft 20. Such axial alignment is adjusted in advance by turning the screws 39, 40 of the jig 30 and moving the slide frames 32, 33.

When the jig 30 is placed on the support surface 21*a* of the holder 21, the jig 30 is fixed to the holder 21 under magnetic attractive forces from the permanent magnet 43. At this time, the support surface 21*a* of the holder 21 is inclined at 45° with respect to an X - Z plane.

Figure 7:
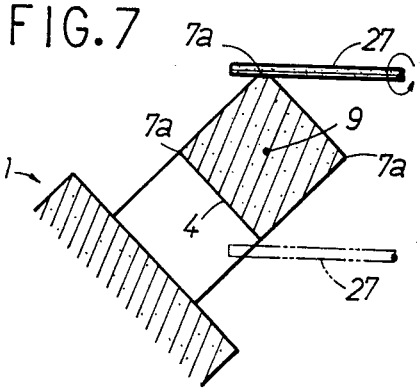
FIGS. 7 and 8 are views showing a process of grinding operation effected by the track slider grinder.

After the jig 30 has been positioned, the numerical control unit 29 moves the guide table 13 in the Z-axis direction and the saddle 23 in the Y-axis direction to bring the rotatable sander 27 of the grinding tool 26 into contact with an edge 7*a* of the coil support portion 7 as shown in FIG. 7, followed by imparting rotary motion to the rotatable sander 27. The rotatable sander 27 now grinds a right-angle corner off the edge 7*a* at an angle of 45°. Simultaneously, the numerical control unit 29 moves the guide table 12 in the X-axis direction to grind the edge 7*a* progressively therealong. The edge 7*a* of the coil support portion 7 is thus ground. Thereafter, the numerical control unit 29 controls the feed motor 17 to retract the guide table 13 and lowers the saddle 23. Then, the numerical control unit 29 advances the guide table 13 again to the original position. The rotatable sander 27 is now brought into contact with a new edge 7*a* which is in diagonally opposite relation to the ground edge 7*a*, and grinds off the new edge 7*a*. After the diagonally opposite edges 7*a* have been ground, the rotatable sander 27 is retracted and waits for a next cycle of grinding operation.

Figure 8:
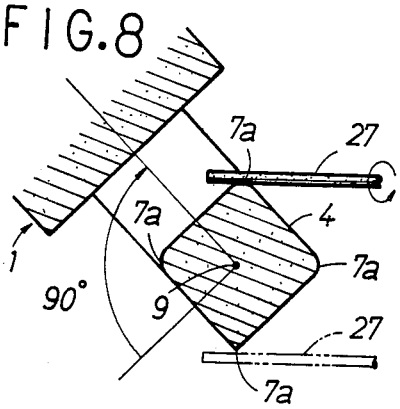

The rotational drive source 22 then turns the support shaft 20 clockwise through 90° as shown in FIG. 8 to guide a new edge 7*a* of the coil support portion 7 into the grinding position. After a lower edge 7*a* has been ground, an upper edge 7*a* starts being ground off. When the four edges 7*a* of the coil support portion 1 have completely been ground off, the entire grinding process for the track slider 1 is finished.

During the grinding process, the rotatable sander 27 rotates at a high speed to grind the edges 7*a* with a grinding surface having minute grinding particles. Therefore, each edge 7*a* is scraped off substantially at 45° and finished to a smooth surface. As the coil support portion 7 is formed of ferrite which is a highly brittle material, an edge formed between the ground surface and an original adjacent side and having a dihedral angle of 135° is finished to a substantially smooth curved surface.

Where the coil 8 is directly wound around the coil support portion 7, the insulating coating of the coil 8 will not be damaged or peeled off in contact with the coil support portion 7, and no short circuit will be caused. Since there is no insulating tape or ring between the coil support portion 7 and the coil 8, electromagnetic coupling between the coil support portion 7 and the coil 8 is greater than would be if any intervening insulating member were used.

In the above embodiment, the holder 21 is driven in the X-axis direction while the grinding tool 26 is driven in the Z- and Y-axis direction. Since the combined three-dimensional movement should finally be effected between the track slider 1 and the grinding tool 26, only one of them may be moved in the X-, Y-, and Z-axis directions.

Figure 9:
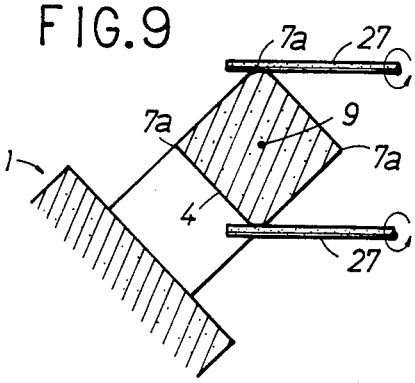
FIGS. 9 and 10 are views showing processes of grinding operation effected by track slider grinders according to other embodiments.

As shown in FIG. 9, two parallel grinding tools 26 may be mounted in spaced relation on the saddle 23 for simultaneous grinding of two diagonally opposite edges 7*a* within a reduced period of time.

Figure 10:
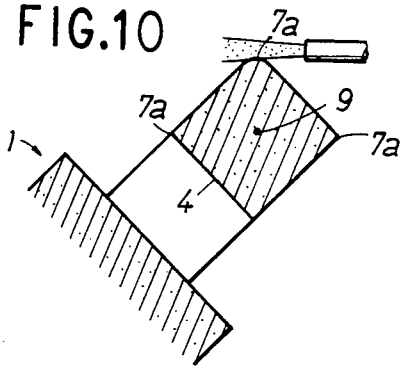

According to another embodiment shown in FIG. 10, the grinding tool 26 may comprise a sand blasting nozzle. In a sand blasting process, grinding sand such as Carborundum or Alundum is ejected across a width from a nozzle. The edge 7*a* can be ground to a more smooth surface than when the rotatable sander 27 is employed. However, since the surface of the coil support portion 7 ground by the sand blasting process is given a dull rough finish, the sand grains used should be extremely small and have to be ejected under an air pressure ranging from 1 to 0.5 $kg/m^2$.

The present invention has the following advantages:

Inasmuch as the edges of the coil support portion of the core are automatically ground off by the grinding tool, they can be finished to more regular surfaces than possible with a manual grinding operation. Since the ground products suffer smaller variations, they are expected to have stable performance. With the grinder of the invention, any insulating tape or ring is not required to be used, and the coil can directly be wound around the ground coil support portion, with the result that the track slider will serve as an electromagnetic transducer of a higher efficiency.

The holder is rotatably supported so that when one of diagonally opposite edges has been ground off, the holder can be rotated to bring the other diagonally opposite edge into the grinding position for successive grinding operation while keeping the grinding tool unchanged in attitude. Therefore, positional control of the grinding tool can be simplified, and no control is required for changing the attitude of the grinding tool.

No matter whether the rotatable sander or the sand blasting nozzle may be used, the desired grinding operation is effected at a high speed, so that the C-shaped core will not be damaged and products can be grounded with a higher yield. As the series of grinding steps is completed within a short period of time, a higher rate of production is achieved by the grinder of the present invention than by the conventional manual grinding operation.

Although certain preferred embodiments have been shown and described, it should be understood that many changes and modifications may be made therein without departing from the scope of the appended claims.

What is claimed is:

1. A device for grinding a track slider of ferrite having a tracing surface and an integral C-shaped core positioned on one side of the tracing surface and including a coil support portion in the form of a quadrangular prism having a central axis, said device comprising:

(a) a holder for supporting the track slider for rotation about the central axis of the coil support portion;

(b) a rotational drive source for angularly displacing said holder through a prescribed angle;

(c) a grinding tool for grinding an edge of the coil support portion of the core into a duller surface;

(d) a three-dimensional guide drive mechanism for relatively moving said grinding tool and said holder in X-, Y-, and Z-axis directions; and (e) a numerical control unit for controlling said three-dimensional guide drive mechanism to position the track slider and said grinding tool relatively to each other and for enabling said grinding tool to grind the edge of the coil support portion of the core while relatively moving said grinding tool and the core in the direction of the central axis of the core.

2. A device according to claim 1, wherein said grinding tool comprises a rod-shaped rotatable sander.

3. A device according to claim 1, wherein said grinding tool comprises a sand blasting nozzle.

* * * * *